US011666927B2

(12) United States Patent
Goellnitz et al.

(10) Patent No.: US 11,666,927 B2
(45) Date of Patent: Jun. 6, 2023

(54) CENTRIFUGE INSERT

(71) Applicant: Eppendorf AG, Hamburg (DE)

(72) Inventors: Robert Goellnitz, Hamburg (DE); Sebastian Ryk, Hamburg (DE)

(73) Assignee: Eppendorf AG, Hamburg (DE)

( * ) Notice: Subject to any disclaimer, the term of this patent is extended or adjusted under 35 U.S.C. 154(b) by 535 days.

(21) Appl. No.: 16/172,752

(22) Filed: Oct. 27, 2018

(65) Prior Publication Data

US 2019/0151862 A1 May 23, 2019

(30) Foreign Application Priority Data

Oct. 27, 2017 (DE) ..... 102017125306.8

(51) Int. Cl.
*B04B 7/12* (2006.01)
*B04B 5/04* (2006.01)
*B01L 9/00* (2006.01)

(52) U.S. Cl.
CPC ..... *B04B 7/12* (2013.01); *B01L 9/523* (2013.01); *B04B 5/0421* (2013.01); *B01L 2300/0829* (2013.01); *B04B 2005/0435* (2013.01)

(58) Field of Classification Search
CPC . B04B 7/12; B04B 5/0421; B04B 2005/0435; B01L 9/523; B01L 2300/0829
USPC ..... 422/548; 494/16, 20
See application file for complete search history.

(56) References Cited

U.S. PATENT DOCUMENTS

| | | | | |
|---|---|---|---|---|
| 4,531,652 | A | 7/1985 | Hara | |
| 5,549,540 | A * | 8/1996 | Moore | B04B 5/0428 248/100 |
| 2014/0010739 | A1* | 1/2014 | Ballhause | B04B 7/08 422/548 |
| 2014/0112845 | A1* | 4/2014 | Edens | G01N 1/2813 422/569 |
| 2014/0179505 | A1* | 6/2014 | David | B04B 5/0421 494/20 |
| 2016/0250608 | A1 | 9/2016 | Anders et al. | |
| 2017/0368560 | A1* | 12/2017 | McElhany | B04B 7/12 |

FOREIGN PATENT DOCUMENTS

| | | | | |
|---|---|---|---|---|
| DE | 3425922 | A1 * | 1/1986 | B04B 5/0421 |
| DE | 3425922 | A1 | 1/1986 | |
| DE | 102012013642 | A1 | 1/2014 | |
| DE | 202013006223 | U | 10/2014 | |
| DE | 202013006223 | U1 * | 10/2014 | B04B 5/0421 |
| JP | S59171759 | | 11/1984 | |

(Continued)

OTHER PUBLICATIONS

DE 3425922 ProQuest Machine Translation.*
DE 202013006223 ProQuest Machine Translation.*

*Primary Examiner* — Shuyi S. Liu
(74) *Attorney, Agent, or Firm* — Von Rohrscheidt Patents

(57) ABSTRACT

A centrifuge insert is provided which is not only suited for one type of sample container or sample carrier but for at least two geometrically different elements from the group consisting of sample container and sample carrier. This achieves that the same centrifuge insert can be used for different sample containers or sample carriers. This provides space savings, in particular in the lab. Furthermore acquisition cost is reduced, and handling is accelerated by reducing manual complexity which increases lab through put.

11 Claims, 16 Drawing Sheets

(56) References Cited

FOREIGN PATENT DOCUMENTS

| | | | |
|---|---|---|---|
| JP | S59171759 | U | 11/1984 |
| JP | S56010946 | U | 9/2010 |
| JP | 2014014817 | A | 1/2014 |
| JP | 2018201439 | | 6/2020 |

* cited by examiner

CENTRIFUGE INSERT

RELATED APPLICATIONS

This application claims priority from and incorporates by reference German patent application DE 10 2017 125 306.8, filed on Oct. 27, 2017.

FIELD OF THE INVENTION

The invention relates to a centrifuge insert for receiving one or plural elements from the group consisting of sample holder and sample carrier in a laboratory centrifuge.

BACKGROUND OF THE INVENTION

Centrifuge rotors are used in centrifuges, in particular laboratory centrifuges, in order to separate components of samples centrifuged therein using their mass inertia. Thus, ever increasing rotation speeds are used to achieve high demixing rates. Thus, laboratory centrifuges are centrifuges whose rotors operate at least at 3,000 rpm, advantageously at least at 10,000 rpm, particularly advantageously at least at 15,000, rpm and which are typically placed on tables. In order to be able to place them on a work bench, they typically have a form factor of less than 1 m×1 m×1 m, thus their installation space is limited. Advantageously the equipment depth is limited to 70 cm at the most.

Typically it is provided that the samples are centrifuged at predetermined temperatures. For example, samples which include proteins and similar organic substances must not be overheated so that an upper limit for tempering such samples is in a range of up to +40 degrees C. On the other hand side, particular samples are cooled down to approximately +4 degrees C. as a standard (anomaly of water starts at 3.98 degrees C.).

In addition to such predetermined maximum temperatures of e.g. approximately +40 degrees C. and standard testing temperatures of e.g., +4 degrees C. also additional standard testing temperatures like, e.g., +11 degrees C. are being used in order to check at this temperature whether the refrigeration system of the centrifuge runs below room temperature in a controlled manner. On the other hand side, it is required for reasons of operator safety to prevent elements from being touched that have a temperature of greater than +60 degrees C.

As a matter of principle active and passive systems can be used for temperature control. Active cooling systems have a refrigeration cycle which controls the temperature of the centrifuge bowl, which cools the centrifuge rotor indirectly and the sample containers receive therein indirectly.

Passive systems are based on exhaust air augmented cooling or ventilation. This air is run directly along the centrifuge rotor which provides tempering. The air is thus pulled through openings into the centrifuge bowl wherein the intake is provided self-acting through the rotation of the centrifuge rotor.

The samples to be centrifuged are stored in sample containers or sample carriers and the sample containers are driven to rotate by the centrifuge rotor. The centrifuge rotors are typically caused to rotate by a vertical drive shaft which is driven by an electric motor. There are various centrifuge rotors which are being used depending on the application.

Typically such centrifuge rotors include a base and a cover so that an interior space is formed in a closed condition of the cover between the base and the cover wherein sample containers can then be arranged in the interior space in order to centrifuge the samples in a suitable centrifuge. When the sample containers or sample carriers are arranged at a predetermined angle in the centrifuge rotor the centrifugal rotor is a so-called fixed angle rotor. When the sample containers or carriers are pivotably arranged in a radial direction with reference to a rotation axis of the centrifugal rotor, then this is designated as a swing out rotor.

The centrifuge inserts are used to arrange the sample containers or sample carriers in the rotors of the centrifuges in order to be able to centrifuge the sample containers or sample carriers.

For example, swing out rotors are known which include a pivotable centrifuge beaker into which the centrifuge insert is insertable.

Many different types of sample containers are known like, e.g., sample flasks, sample beakers, sample tubes, reaction vessels, centrifuge vessels, flasks, microreaction vessels or cell culture flasks which can also be provided in different sizes. These sample containers can also have different base configurations, for example flat, conical or rounded. Furthermore, there are also different types of sample carriers, e.g., microplates, microtiter plate (MTP), PCR-plates and deep well plates (DWP). Typically the sample containers have an individual receiver for samples and sample carriers have a plurality of receivers for the samples.

It is a disadvantage that individual centrifuge inserts are required for each sample container or each sample carrier. Thus, users have to store various centrifuge inserts which are expensive to buy and take a lot of storage space.

BRIEF SUMMARY OF THE INVENTION

Thus, it is an object of the invention to overcome these disadvantages. The object is achieved by a centrifuge insert for receiving one or plural elements from a group consisting of sample container and sample carrier in a centrifuge rotor of a laboratory centrifuge that is configured as a swing out rotor, wherein the centrifuge insert is adapted to receive at least one first element which has a circular or oval cross section at least in portions or at least one second element which has a polygonal cross section at least in portions.

Advantageous embodiments are provided in the dependent claims and in the subsequent description in conjunction with the drawing figures.

It was found by the inventors that the object can be achieved in a surprising simple manner in that a centrifuge insert is provided which is not only suitable for a certain type of sample container or sample carrier but for at least two elements from the group consisting of sample container and sample carrier that are configured differently. Thus, one type shall include a cross section that is circular or oval at least in portions and the other type shall include a cross section that is polygonal, in particular rectangular, at least in portions. Thus, optionally geometrically different elements can be centrifuged by the centrifuge insert in the centrifuge rotor.

Thus, supplemental elements can be used. This, however, is not mandatory This can also be an alternative arrangement option for the different elements. However, the centrifuge insert could also be adapted to receive both different elements simultaneously.

This solution according to the invention achieves that the same centrifuge insert can be used for elements with different geometries. This leads to space savings, in particular in the lab. Furthermore acquisition cost is reduced.

The centrifuge insert according to the invention for receiving one or plural elements from the group sample container and sample carrier in a centrifuge rotor of a centrifuge which is advantageously configured as a swing-out rotor, in particular a laboratory centrifuge, is characterized in that the centrifuge insert is adapted to optionally receive a first element which has a circular or oval cross-section at least in portions and at least one second element which has a polygonal cross-section at least in portions. The polygonal cross-section is advantageously a rectangular cross-section.

In an advantageous embodiment it is provided that the first element is a sample container, advantageously a sample flask, a sample tube, a reaction vessel, a centrifuge vessel, a flask, a microreaction vessel or a cell culture vessel and in particular has a conical, flat or rounded base. Then typical sample holders can be centrifuged by the centrifuge insert.

In another advantageous embodiment it is provided that the second element is a sample carrier, advantageously a plate-shaped element, in particular configured as a microplate, a microtiter plate, a PCR plate or a deep well plate with several receivers for samples. Then, typical sample carriers with numerous receivers for a plurality of samples can be centrifuged by the centrifuge insert.

In an advantageous embodiment it is provided that the centrifuge insert is adapted to receive the elements in a form locking manner. Thus, the elements are supported very reliably also during centrifugation operations.

In an advantageous embodiment it is provided that the base configuration of receivers of the centrifuge insert is adapted to the base configuration of sample containers and/or sample carriers to be received and advantageously has a flat, conical or rounded contour. Thus, a particularly safe support of the sample containers or sample carriers is provided in the centrifuge insert.

In an advantageous embodiment it is provided that the centrifuge insert is configured modular with a base element and at least one supplemental element, wherein the supplemental element is advantageously configured placeable into the base element, in particular pluggable into and/or placeable onto the base element, in particular pluggable onto the base element, wherein in particular a plug connection, advantageously a groove and key connection, is configurable between the base element and the supplemental element. Thus, the centrifuge insert is easily adaptable to particular requirements of individual sample containers or sample carriers. Still, space savings and cost savings are provided because only one base element and one or plural supplemental elements have to be purchased and stored.

In an advantageous embodiment it is provided that the plug connection provides friction locking and/or form locking, advantageously with clamping properties. Thus the supplemental element is supported in the base element in a particularly safe manner. For example, a key and groove connection can be provided in which the key expands conically with reference to the insertion direction.

In an advantageous embodiment it is provided that the supplemental element includes one or plural receivers for first elements and/or that the supplemental element has an exterior geometry which forms one or plural receivers for first elements in combination with a corresponding interior geometry of the base element. Thus, the centrifuge insert is configurable in a particularly variable manner and can still receive a maximum number of sample containers.

In an advantageous embodiment it is provided that the centrifuge insert is only configured to laterally fixate the first and/or the second elements. A lateral fixation of this type can be achieved e.g. by at least partially provided recesses or grooves and/or by at least partially provided bars or protrusions which correspond with respective elements like, e.g., edges of the first or second elements. Thus, a very simple and effective receiving is provided wherein first or second elements with different sizes can be received by different grids of recesses or bars and protrusions. A second element of this type can be configured as a sample carrier, e.g., a microtiter plate. A second element of this type can be enveloped laterally at least partially by the bars or protrusions, and/or the recesses or grooves.

In an advantageous embodiment it is provided that the centrifuge insert is configured to vertically fix the first and/or second elements. A vertical fixing of this type can be achieved, for example, by an interlocking and/or clip connection. The bars or protrusions can interlock, for example, with a circumferential edge of the first or second elements.

In an advantageous embodiment it is provided that the centrifuge insert is adapted to receive the first elements by plugging into the respective receivers of the centrifuge insert. Then the first elements, in particular configured as sample containers, are reliably supported.

In an advantageous embodiment it is provided that the centrifuge insert is adapted to support the second elements, wherein the second elements are advantageously fixed laterally on a base surface in a form-locking manner. Then the second elements, in particular configured as sample carriers, are supported reliably.

In an advantageous embodiment it is provided that the centrifuge insert includes at least two supports that are arranged opposite to each other and which are adapted to laterally support at least one supplemental element and/or at least one second element, advantageously at least two supplemental elements or second elements that are stacked on top of each other. Thus, a particularly reliable reception is provided.

In an advantageous embodiment it is provided that the supports are configured as grips for gripping the centrifuge insert. Then the centrifuge insert can be transported particularly easily and manipulated in a centrifuge. The grips can alternatively have no support function and only have a grip function.

In an advantageous embodiment it is provided that the supports include interlocking elements which are configured to provide an interlocking connection between the supports and the supplemental element and/or the second element. Thus, the receiver is secured even better.

BRIEF DESCRIPTION OF THE DRAWINGS

Features and additional advantages of the instant invention are subsequently described based on advantageous embodiments with reference to drawing figures, wherein.

DETAILED DESCRIPTION OF THE INVENTION

FIGS. 1 through 5 illustrate a first advantageous embodiment of the centrifuge insert 10 according to the invention in various views.

Figure 1:
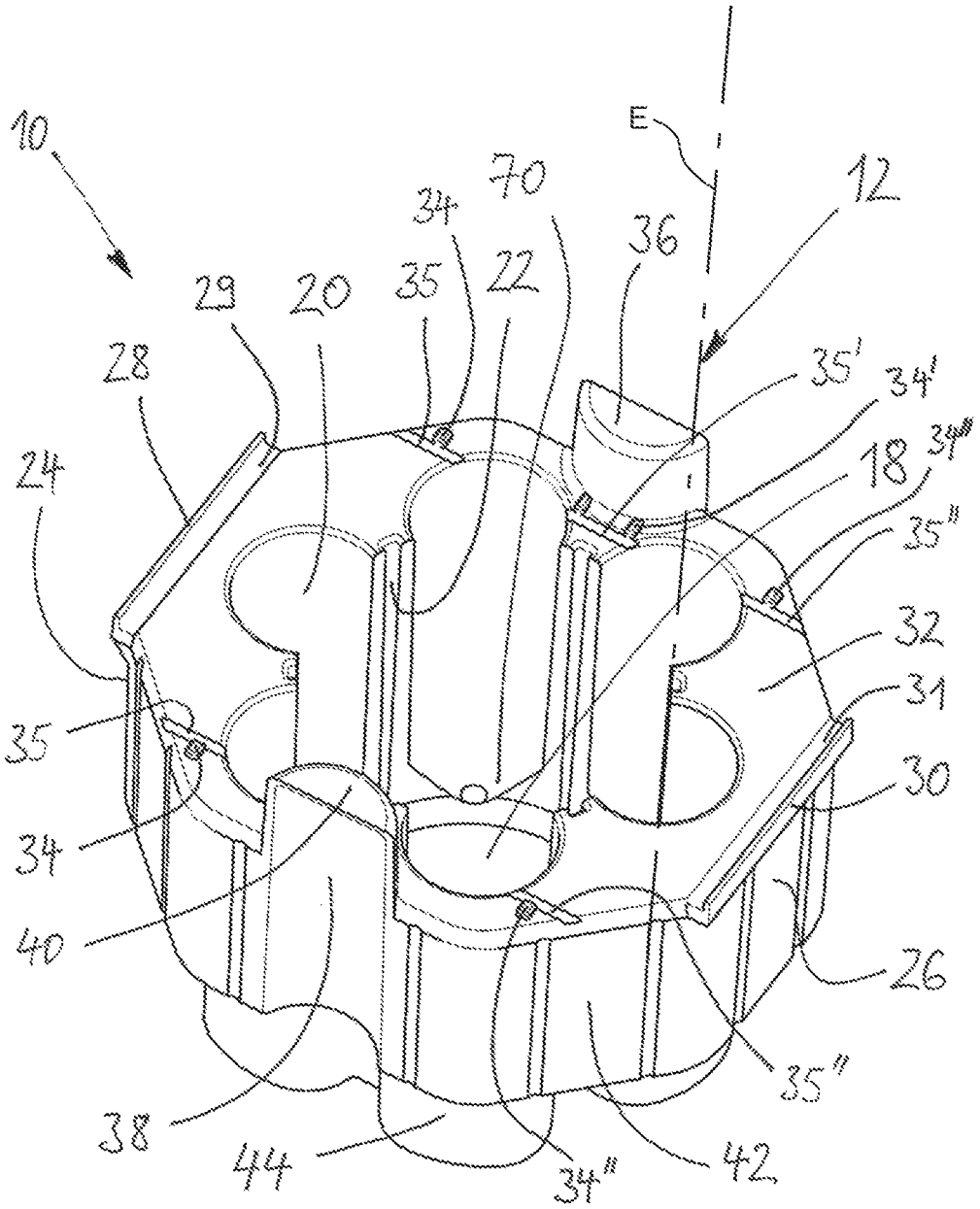
FIG. 1 illustrates the base element of the centrifuge insert according to the invention according to a first advantageous embodiment in a perspective view.
Figure 2A:
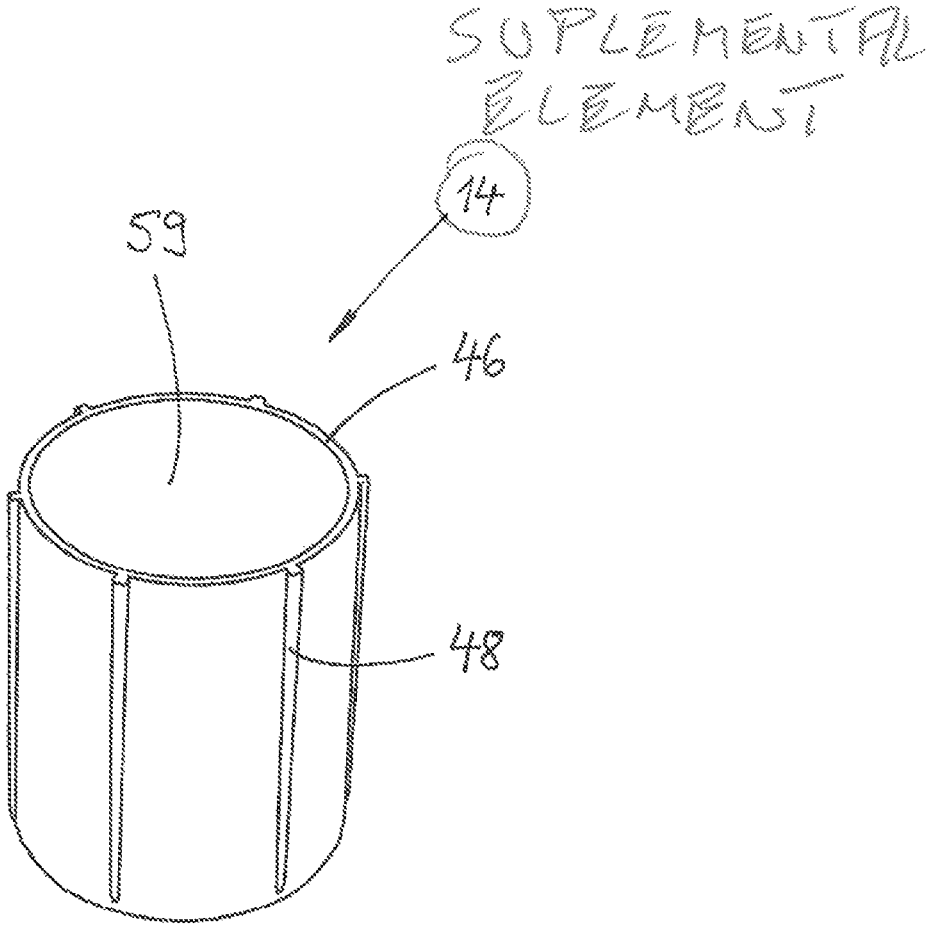
FIGS. 2A and 2B illustrate two supplemental elements for the base element of the centrifuge insert according to FIG. 1 in perspective views.
Figure 2B:
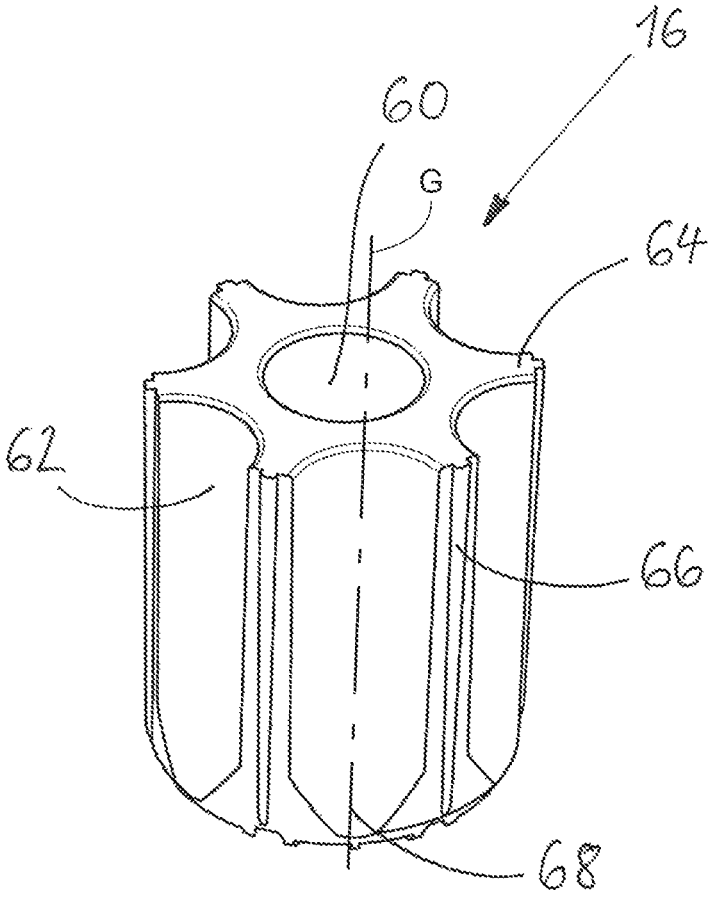
Figure 3:
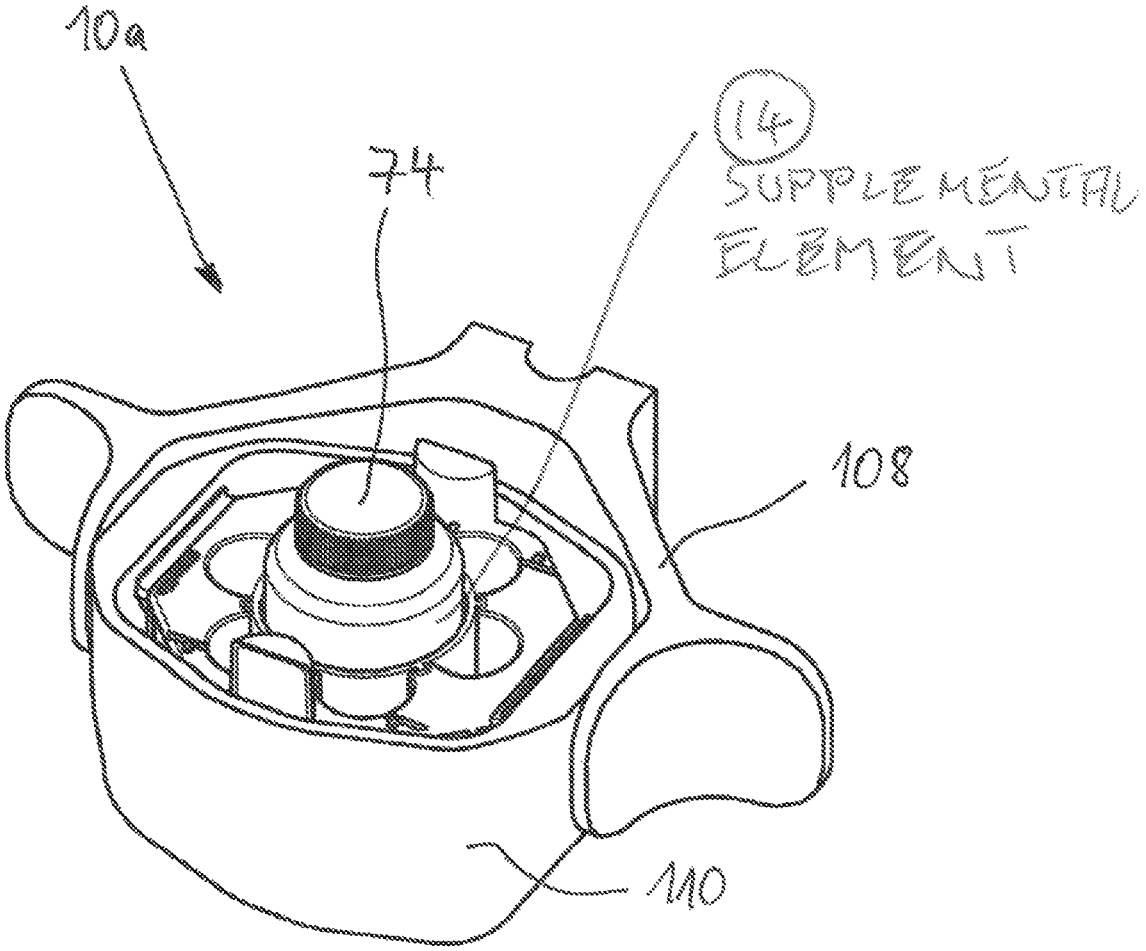
FIG. 3 illustrates the centrifuge insert according the invention according to FIG. 1 in a first application in a perspective view.
Figure 4:
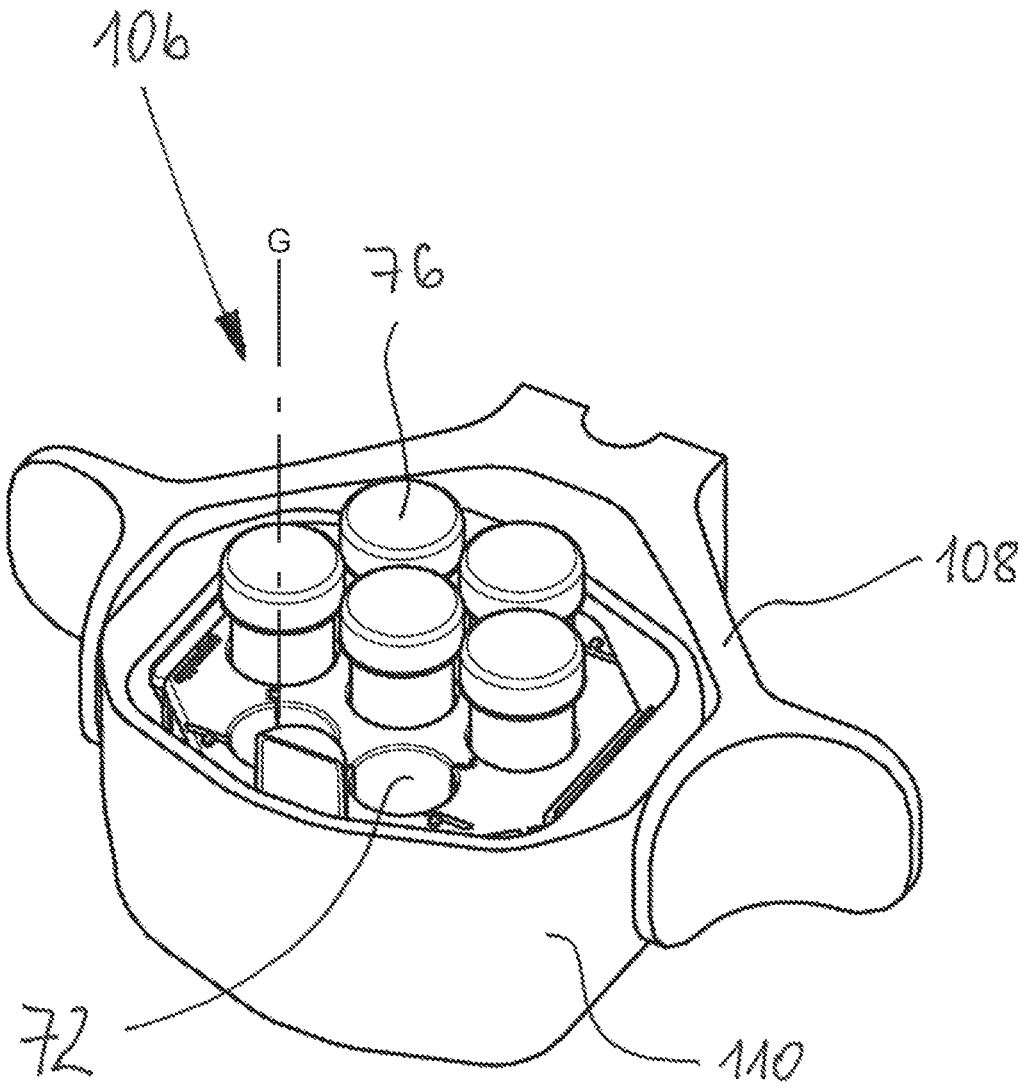
FIG. 4 illustrates the centrifuge insert according to the invention according to FIG. 1 in a second application in a perspective view.
Figure 5:
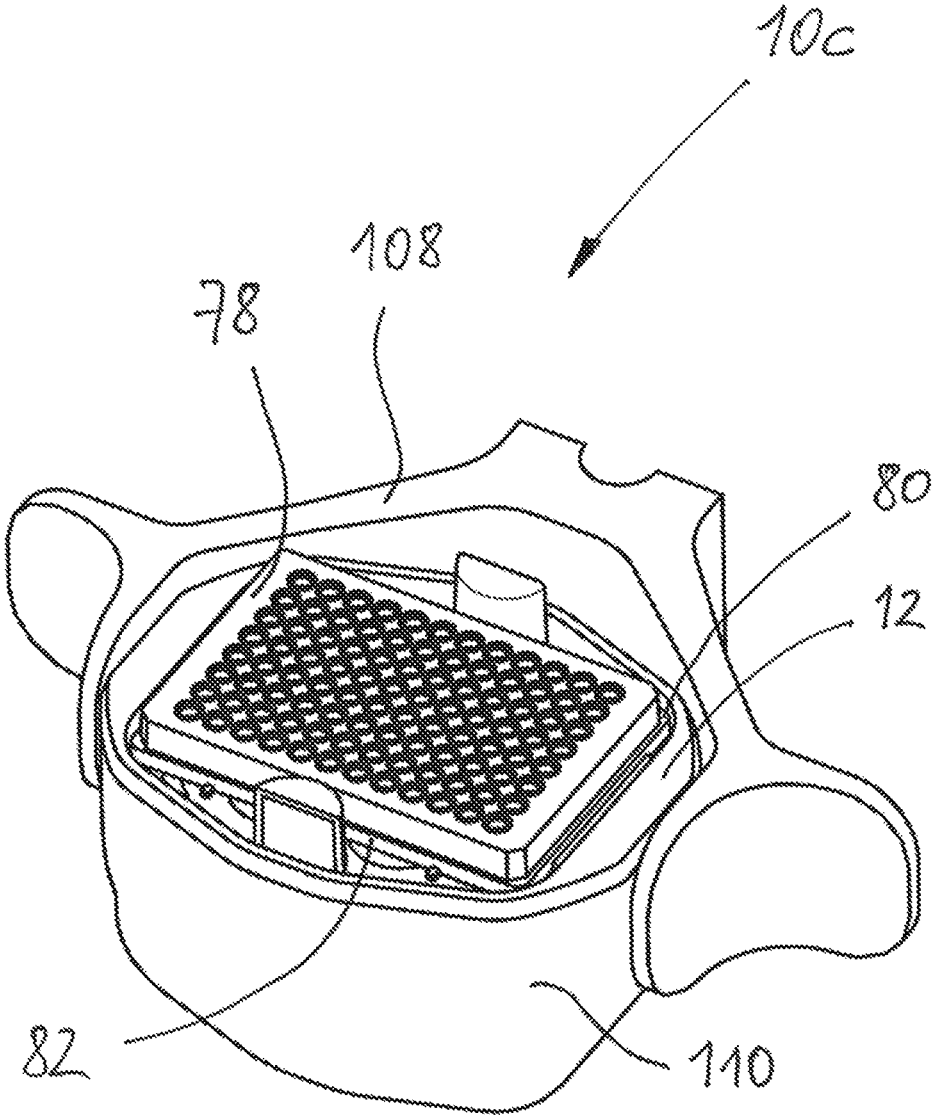
FIG. 5 illustrates the centrifuge insert according to the invention according to FIG. 1 in a third application in a perspective view.

More precisely, FIG. 1 illustrates the base element 12 of the centrifuge insert 10. FIGS. 2A and 2B illustrate two supplemental elements 14, 16 for the base element 12, and FIGS. 3 through 5 illustrate various combination options of the base element 12 and the supplemental elements 14, 16 and applications resulting therefrom.

It is evident that the base element 12 essentially has an octagonal cross-section and a central recess 18 which corresponds with six cylinder segment-shaped recesses 20 that are evenly spaced along the circumference. A vertically extending groove 22 is arranged between two adjacent recesses 20 respectively having an axis of curvature E and recessed upward with respect to the central recess 18. Instead of the octagonal cross-section also a different cross-section can be provided.

At both outsides 24, 26 of the octagonal cross-section there are bars 28, 30 which protrude upward vertically relative to the base surface 32 of the base element 12. Furthermore, there are opposite bars 34, 34', 34" that are arranged on the base surface 32 wherein the bars 28, 30, 34, 34', 34" enclose a rectangular portion between each other which is configured to receive a rectangular cross-section of a second element or a sample carrier in a form-locking manner. Recesses 29, 31 are arranged in front of the bars 28, 30 with reference to the base surface 32, and grooves 35, 35', 35" are arranged in front of the bars 34, 34', 34".

Last but not least grips 36 are provided which extend vertically upward from the base surface 32 and which respectively include a semi-cylindrical space 38 and a cover surface 40 on top. Thus, a handle 36 is provided for gripping the centrifuge insert 10, which can be gripped particularly reliably through the spaces 38.

Below the base surface 32 there is an edge 42 wherein the outside walls 44 of the central recess 18 and of the recesses 20 are radially recessed relative to the edge 42, FIG. 2A illustrates a first supplemental element 14 for the base element 12 which is essentially configured as a hollow cylinder with a wall 46 wherein outward protruding ribs 48 extend from the wall 46 with equidistant, radial spacing. The wall 46 thus has an outer circumference which is fitted to the inner circumference of the central recess 18. The ribs 48 taper in a downward direction into a point and become flatter and thus correspond to the grooves 22 and which also become narrower and flatter from the base surface 32. Thus, a clamping effect is obtained when inserting the supplemental element 14 into the base element 12 so that the supplemental element 14 is reliably retained by friction and form locking in the base element 12.

Through the configuration as a hollow cylinder of the supplemental element 14 an axial recess 59 is formed which can receive a circular cross section of a first element or of a sample container in a form locking manner, FIG. 2B illustrates a second supplemental element 16 for the base element 12 wherein the second supplemental element is essentially configured star-shaped in the center there is an axial receiver 60 and at the end there are six cylinder segment shaped recesses 62 arranged with equidistant spacing and respectively having an axis of curvature F, wherein bars 64 extend between the recesses 62 and wherein ribs 66 according to FIG. 2A are arranged on the bars 64. The ribs 66 in turn can engage the grooves 22 of the base element 12 with a fit so that a clamping effect is obtained when the supplemental element 16 is inserted into the base element 12 so that the supplemental element 16 is reliably retained in the base element 12.

It is furthermore evident that the recesses 62 taper downward into a conical shape 68, wherein this shape corresponds with conical tapers 70 of the recesses 20. Thus, receivers 72 (c.f. FIG. 4) are formed after inserting the supplemental element 16 into the base element 12 which taper conically in the downward direction and are thus configured for sample containers with a base portion that tapers conically. The axial receiver 60 has exactly the same geometry so that seven identical receivers 60, 72 are provided.

In FIG. 3 the centrifuge insert 10*a* according to the invention is configured as a combination of the base element 12 and the supplemental element 14 and illustrated in a swingout beaker 110 of an only partially illustrated swing out rotor 108 of a laboratory centrifuge 100. Thus, an individual sample holder 74 can be centrifuged which is configured in an exemplary manner as a wide neck bottle with a volume of 250 ml. Since the axial receiver 59 has a width that is adapted to a circular cross section of the sample container 74, the sample container 74 is received in the centrifuge insert 10*a* in a safe form locking manner.

In FIG. 4 the centrifuge insert 10*b* is configured as a combination of a base element 12 and supplemental element 16 and illustrated in the swing out beaker 110 of a partially illustrated swing out rotor 108 of a laboratory centrifuge 100. Thus individual sample holders 76 can be centrifuged that are configured as sample tubes with a volume of 50 ml. Since the recesses 60, 72 have a width that is adapted to the circular cross section of the sample containers 76 respectively having an axis of curvature G the sample containers 76 are received in the centrifuge insert 10*b* in a form locking manner and thus safely received.

As evident from FIGS. 1, 2B and 4 of the invention mass forces from a liquid content of the at least one first element 76 are reacted by the at least one first element 76 and transferred from closed base of the at least one first element 76 to the base element 12 and from the closed base of the at least one first element 76 to the first supplemental element 16 respectively in a direction of an axis of curvature of the circular or oval cross section of the at least one first element 76 and the first supplemental element 16 includes a third circumferentially closed internal geometry 60 which forms a third circular or oval receiver for the at least one first element 76 in a center of the first supplemental element 16.

In FIG. 5 the centrifuge insert 10*c* according to the invention is configured as a combination of the base element 12 and the supplemental element 14 and illustrated in the swing out beaker 110 of a partially illustrated swing-out rotor 108 of a laboratory centrifuge 100. Thus, e.g., individual sample carriers 78 can be centrifuged which are configured as microtiter plates. Since the rectangular portion that is enveloped by the bars 28, 30, 34, 34', 34" is adapted to the essentially rectangular base surface 80 of the microtiter plate 78 and the edge 82 of the base surface 80 can penetrate into the grooves 35, 35', 35" and into the recesses 29, 31 the microtiter plate 78 is fixed laterally in a form-locking manner at the centrifuge insert 10*c* and thus reliably received (thus, also FIG. 9B which illustrates a similar interaction). In this application also the supplemental element 16 can be inserted or no supplemental element 14, 16 is inserted, however, the sample carrier 78 is always laterally supported in a reliable manner.

As an alternative to this embodiment also the supplemental element 16 can be inserted into the base element 12. However, no supplemental element 14, 16 has to be inserted into the base element 12 since the sample carrier 78 is supported on the base surface 32 so that the base element 12 can form the centrifuge insert 10 already by itself.

Figure 6:
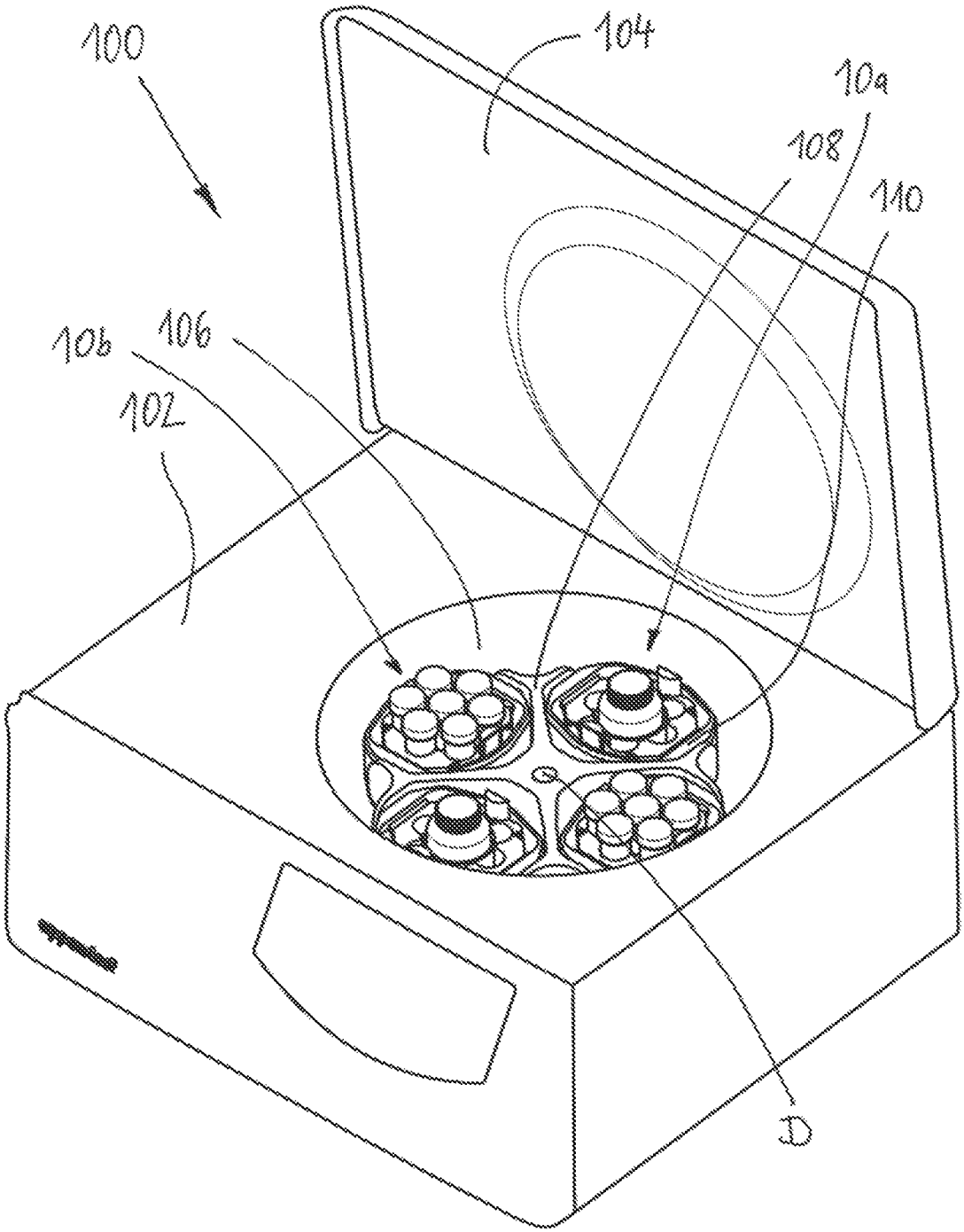
FIG. 6 illustrates a laboratory centrifuge with a centrifuge rotor and the centrifuge insert arranged therein in a perspective view.
Figure 7:
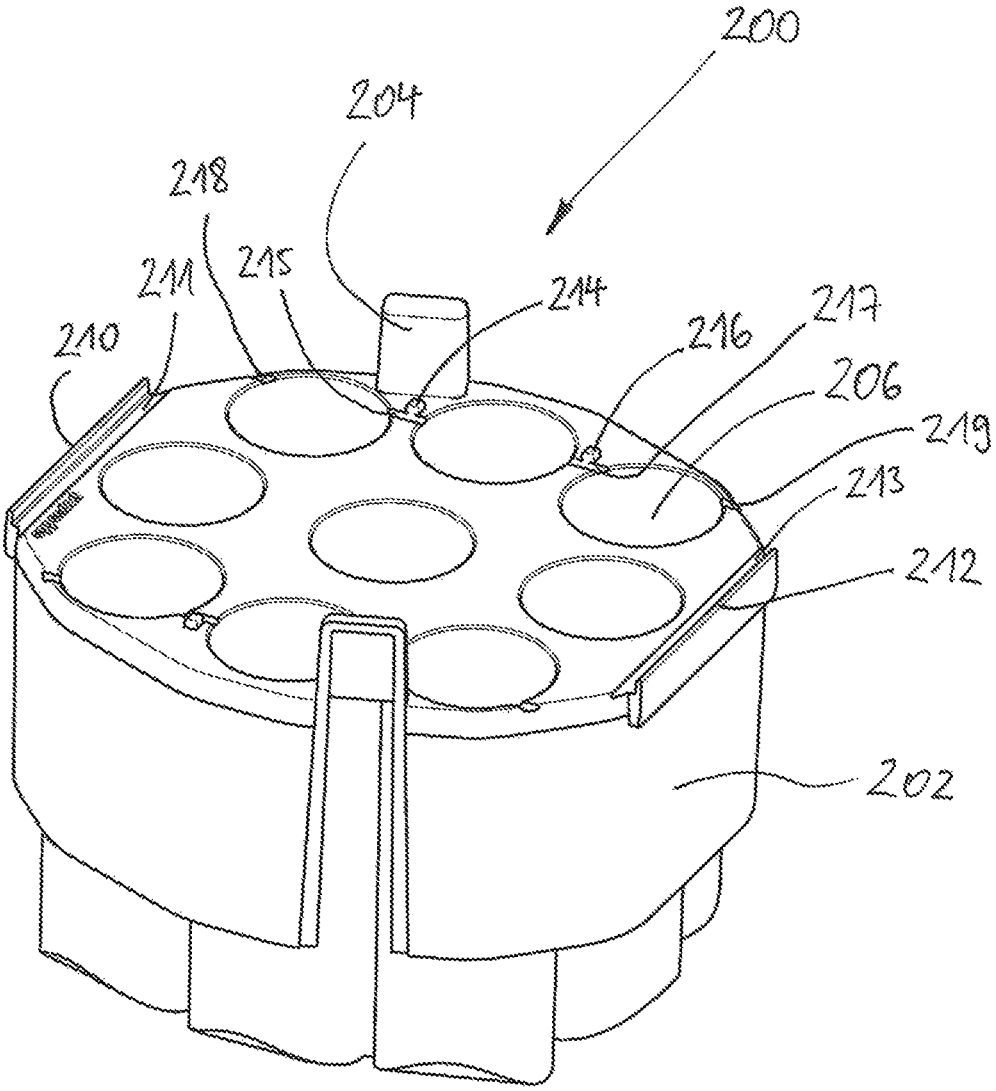
FIG. 7 illustrates the centrifuge insert according to the invention according to a second advantageous embodiment in a perspective view.

FIG. 6 illustrates the centrifuge insert 10*a* according to the invention in cooperation with a laboratory centrifuge 100 in a perspective view. It is evident that the laboratory centrifuge 100 includes a housing 102 with a cover 104 that is configured to close the sample cavity 106 in which a motor driven non-illustrated centrifuge 108 is arranged. The centrifuge rotor 108 is configured as a swing-out rotor and includes centrifuge beakers 10 which are configured to pivot away from the rotation axis D, thus in an outward direction during the centrifugation. Centrifuge inserts 10*a* according to the invention are received in the centrifuge beakers 110.

FIGS. 7 through 9B illustrate a second advantageous embodiment of the centrifuge insert 100 in various views.

It is evident that the centrifuge insert 200 differs from the centrifuge insert 10 in that the base element 202 with the grips 204 is configured without a central receiver for receiving supplemental elements. Instead, nine identical receivers 206 are arranged directly in the base element 202, which correspond in principle to the receivers 60, 72 of the centrifuge insert 10*a* and are configured with identical inner diameters.

Also here upward protruding bars 210, 212, 214, 216 are provided on a base surface 208 wherein the upward protruding bars envelop a rectangular surface. Simultaneously recesses 211, 213 and grooves 215, 217, 218, 219 are provided.

Contrary to the centrifuge insert 10 the grips 204 are not symmetrically arranged with reference to the bars 210, 212 or slightly offset so that they can be arranged between two receivers 206. Thus, the grip function of the grips 204 is not impaired since they are still symmetrically arranged with reference to the center of mass which is arranged in a center of the central receiver 206.

Figure 8:
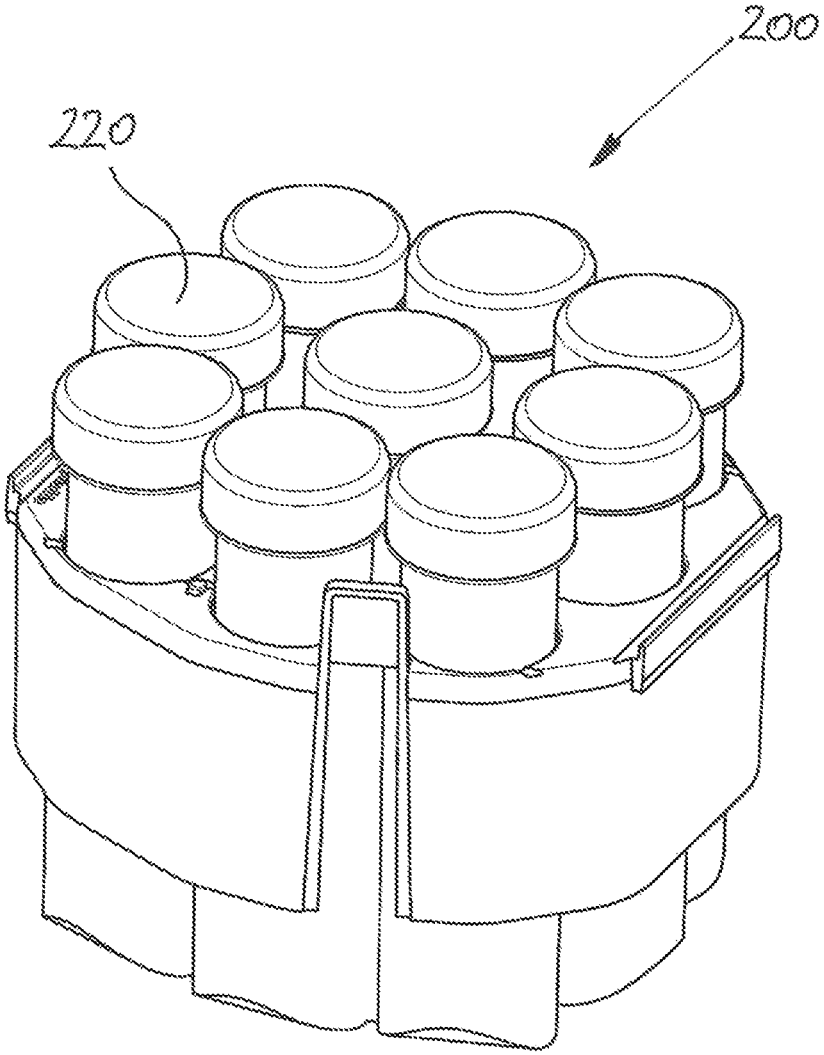
FIG. 8 illustrates the centrifuge insert according to the invention according to FIG. 7 in a first application in a perspective view.

FIG. 8 illustrates the centrifuge insert 200 according to the invention in a first application where it receives nine sample containers 220 which are configured as sample tubes with a capacity of 50 ml and can thus be centrifuged in the laboratory centrifuge 100. Since the receivers 206 have a width that is adapted to the circular cross-section of the sample containers 220 the sample container 220 are received in the centrifuge insert 200 in a form-locking and thus safe manner.

Figure 9A:
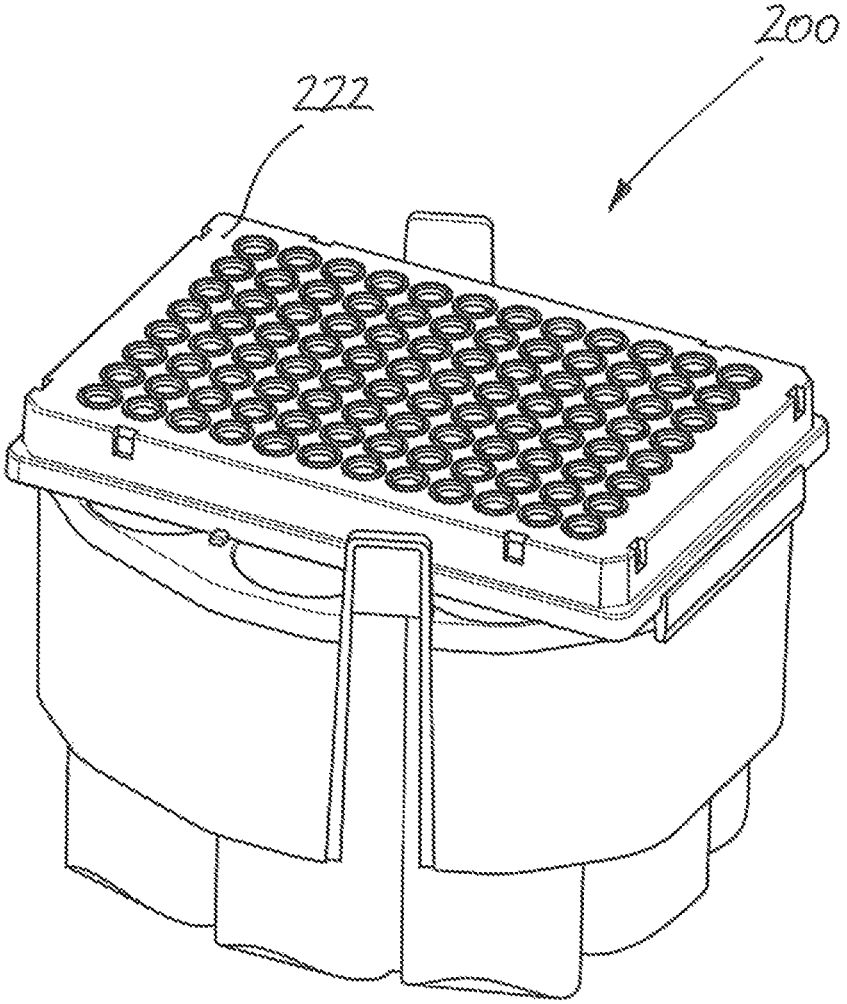
FIGS. 9A, 9B illustrate the centrifuge insert according to the invention according to FIG. 7 in a second application in a perspective view and in a side view.
Figure 9B:
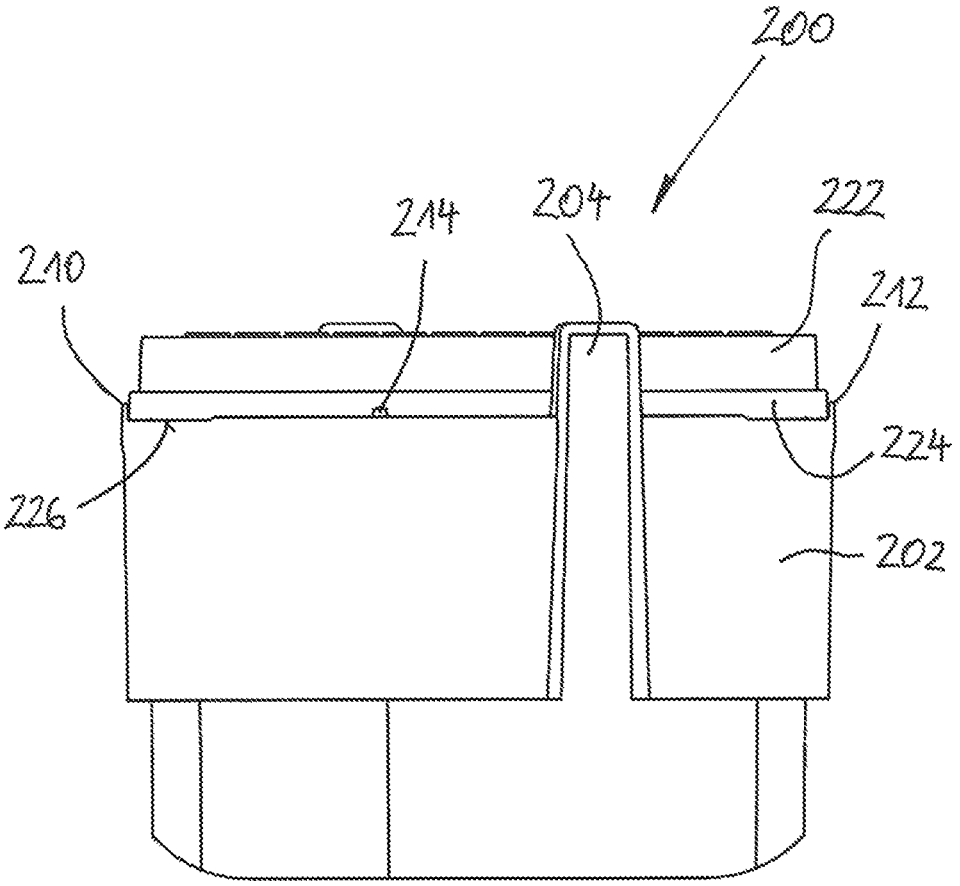

In FIGS. 9A and 9B the centrifuge insert 200 according to the invention is illustrated in two views in a second application of the receiver of a sample container 222 which is configured as a microtiter plate. Since the rectangular portion that is enveloped by the bars 210, 212, 214, 216 is adapted to the essentially rectangular base surface 224 of the microtiter plate 222 and the edge 226 penetrates into the recesses 211, 213 and grooves 215, 217, 218, 219 the microtiter plate 222 is fixed laterally in a form-locking manner at the centrifuge insert 200 and thus reliably received as evident in particular from FIG. 9B. Additionally, a snap-locking connection or interlocked connection can be provided between the bars 210, 214, 216 and the edge 226 in order to fix the sample carrier 222 also vertically.

FIGS. 10 through 13 illustrate a third advantageous embodiment of the centrifuge insert 300 in various views.

Figure 10:
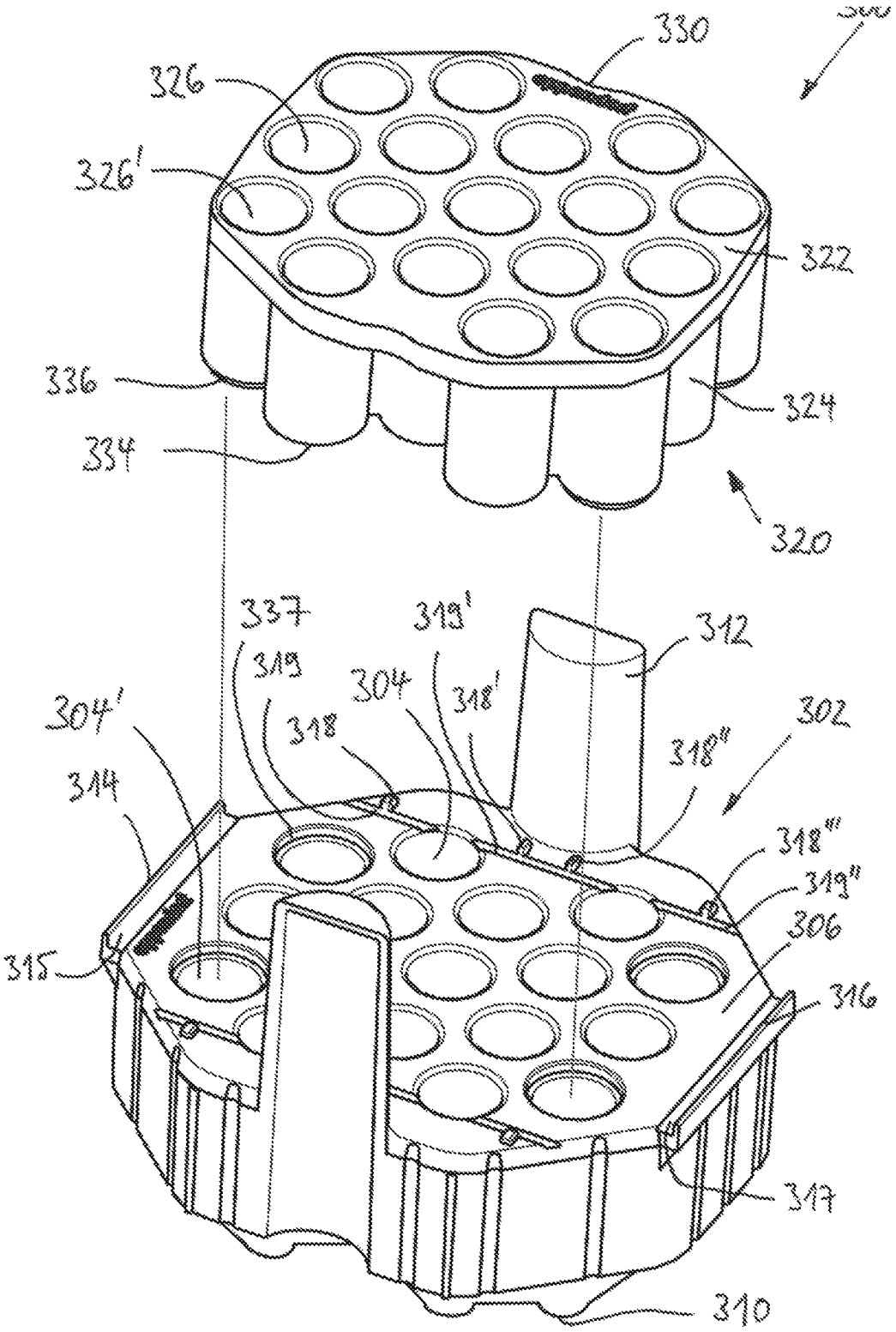
FIG. 10 illustrates the base element and the supplemental element of the centrifuge insert according to the invention in a third advantageous embodiment in a perspective view.
Figure 11:
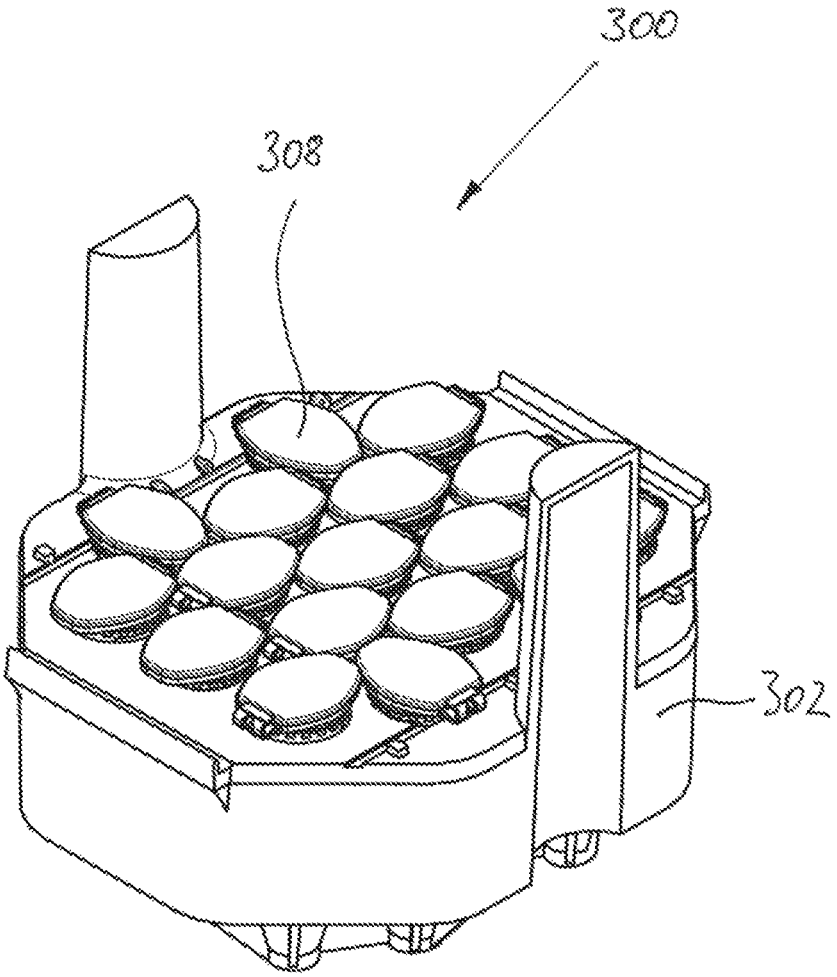
FIG. 11 illustrates the centrifuge insert according to the invention according to FIG. 10 in a first application in a perspective view.

FIG. 10 illustrates the base element 302 of the centrifuge insert 300 which differs from the base element 202 of the centrifuge insert 200 in that a greater number of receivers 304 is provided in the base surface 306. These receivers 304 are adapted to receive sample containers 308 which are provided as reaction vessels with 5 ml volume, since the receivers 304 have a width that is adapted to a circular cross-section of the sample containers 308 the sample containers 308 are received in the centrifuge insert 300 in a form-locking and thus safe manner (c.f., the first application illustrated in FIG. 11).

It is furthermore evident that the base surface 302 does not protrude relative to the bottom surface 310 of the base element by the same amount. Therefore, the grips 312 can be configured longer with reference to a particular centrifuge beaker 110 (c.f., FIG. 6). Otherwise, a rectangular surface is also enveloped in case of this base element 302 by bars 314, 316, 318', 318", 318'" and recesses 315, 217 and grooves 319, 319', 319".

FIG. 10 also illustrates a supplemental element 320 which has a base surface 322 and walls 324 that extend downward from the base surface 322 wherein the walls include plural receivers 326 which base surfaces are respectively missing so that the receivers are configured as hollow cylinders with constant cross-section over an entire length. The receivers 326 are adapted to receive sample containers 328 which are provided as sample flasks with 15 ml volume.

Figure 12:
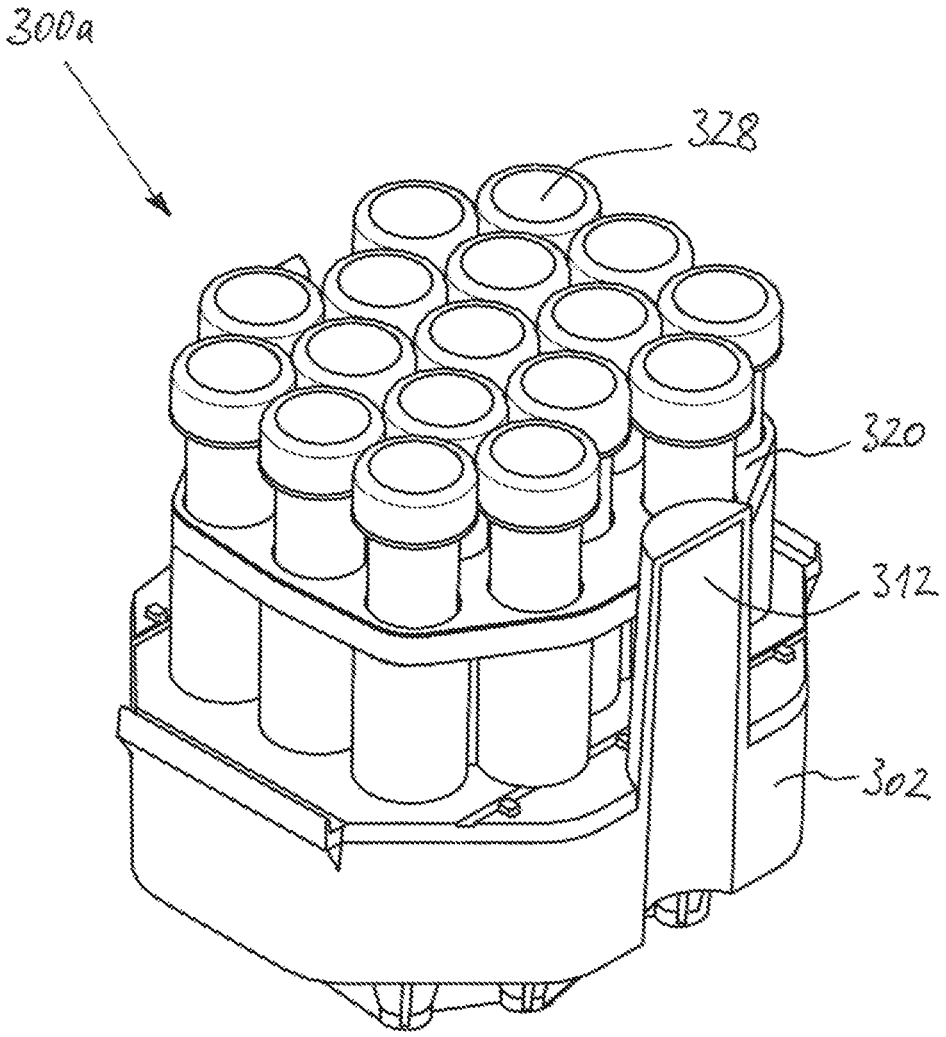
FIG. 12 illustrates the centrifuge insert according to the invention according to FIG. 10 in second application in a perspective view.

In FIG. 12 it is furthermore evident that the grips 312 engage the recesses 330 of the supplemental element 320 with an outer contour of the grips so that the supplemental element is laterally fixed between the grips 312 and thus also safely arranged at the base element 302 during centrifugation operations. Furthermore, this configuration of the supplemental element 320 provides a threading and positioning aid so that the receivers 326 of the supplemental element can be positioned directly above the receivers 304 of the base element 302. The grips 312 thus simultaneously form supports for the supplemental element 320. Additionally, there could be a snap interlocking between the grips 312 and the supplemental element 320.

Furthermore, the supplemental element 320 includes annular protrusions 336 at plural locations of its base surface 334 at the receivers 326' which engage recesses 304' of the base element 302 in a form-locking or friction-locking manner. Thus the receivers 304' of the base element 302 include an additional groove 337 into which the annular protrusions 336 are insertable. Thus, an additional lateral fixing of the supplemental element 320 is provided relative to the base element 302. The inner diameters of the receivers 326, 326' of the supplemental element 320 of the receivers 304, 304' of the base element 302 are identical so that a continuous receiver 304, 304', 326, 326' is provided.

Due to this friction-locking and form-locking connecting of annular protrusions 336 and grooves 337, an additional friction-locking or form-locking with the grips 312 can be omitted.

The sample containers 328 have a rather great length. Through the continuous configuration of the receivers 304, 304', 326, 326' and the adaptation of their width to the circular cross-section of the sample containers 328, the sample containers 328 are received in a form-locking manner and thus safely in the centrifuge insert 300*a* which is formed by base element 302 and the supplemental element 320 wherein the sample containers 328 reach into the base element 302 and are laterally supported by the base element 302 as well as by the supplemental element 320 as illustrated in FIG. 12.

Figure 13:
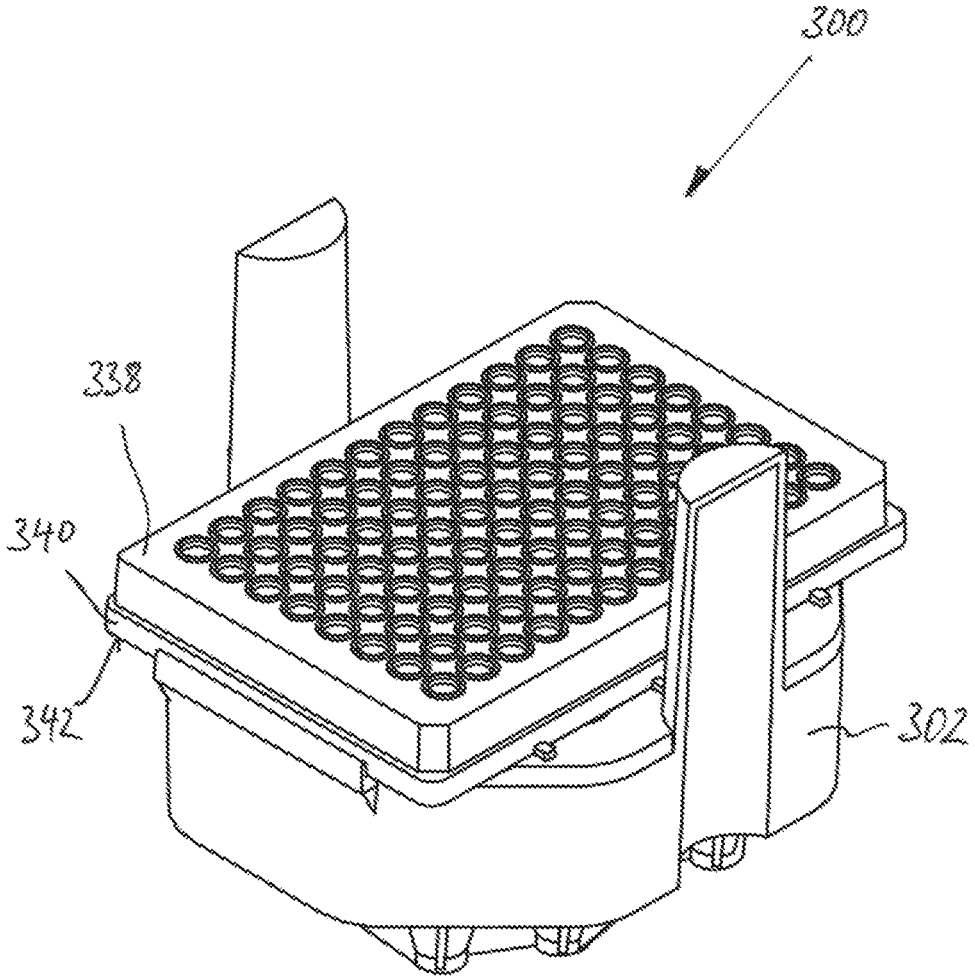
FIG. 13 illustrates the centrifuge insert according to the invention according to FIG. 10 in a third application in a perspective view.
Figure 14A:
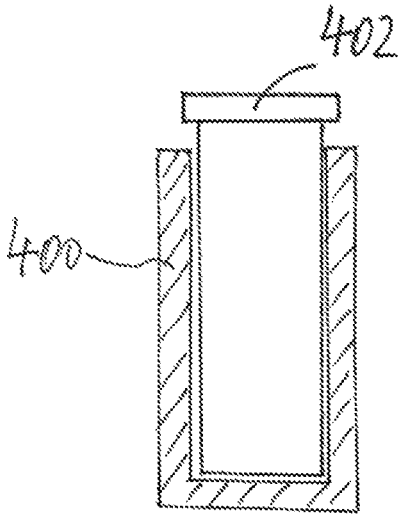
FIG. 14A, 14B, 14C illustrate receivers of centrifuge inserts according to the invention cooperating with sample containers received therein a cross-sectional view.
Figure 14B:
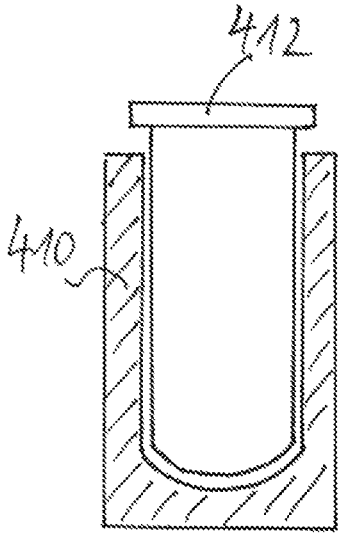
Figure 14C:
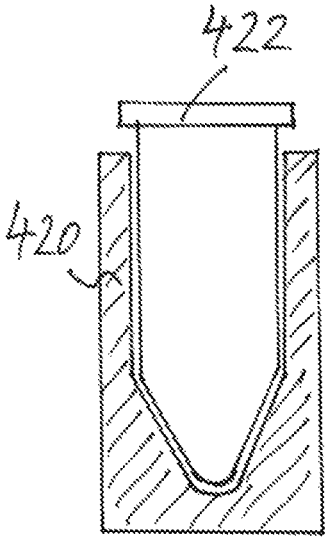

FIG. 13 illustrates a third embodiment of the centrifuge insert 300 wherein a sample carrier 338 configured as a microtiter plate is arranged on the base element 302. Since the rectangular portion that is framed by the bars 314, 316, 318, 318', 318", 318'" is adapted to the essentially rectangular base surface 340 of the microtiter plate 338 and the edge 342 penetrates into the recesses 315, 317 and the grooves 319, 319', 319", the microtiter plate 338 is in turn laterally fixed in a form-locking manner at the centrifuge insert 300 and thus safely received, In FIGS. 14A, b, c eventually three receivers 400, 410, 420 of centrifuge inserts according to the invention are schematically illustrated in cooperation with respectively received sample containers 402, 412, 422 in a cross-sectional view. It is evident that the base configurations of receivers 400, 410, 420 and sample containers 402, 412, 422 are adapted to each other so that a respective form locking is provided (a distance between the side walls is only illustrated to provide better visibility), so that the sample containers 402, 412, 422 are particularly reliably supported in the receivers. Thus FIG. 14A illustrates a flat base configuration of the respective receiver 400, 410, 420 and sample containers 402, 412, 422 and FIG. 14B illustrates a flat base configuration and FIG. 14C illustrates a conical base configuration.

Though particular sample containers 74, 76, 220, 308, 328, 402, 412, 422 and sample carriers 78, 222, 338 were described supra, the centrifuge insert according to the invention can also be adapted to other sample containers and sample carriers, in particular with a different geometry and base configuration and/or a different volume of the receiver.

It is evident from the preceding illustration that the instant invention provides a centrifuge insert 10, 10*a*, 10*b*, 200, 300, 300*a* which can be used for different sample containers 74, 76, 220, 328 or sample carriers 78, 222, 338. This leads to space savings, in particular in the lab. Furthermore, acquisition cost is reduced, and manual labor is reduced which speeds up handling which increases a throughput of the lab.

Unless state differently all features of the instant invention can be combined with each other freely. Also the features described in the figure description can be freely combined with other features of the invention unless stated differently. Thus, device features of the centrifuge insert can also be used in a context of a method when phrased into method features and method features for using the centrifuge inserted can be phrased into device features.

REFERENCE NUMERALS AND DESIGNATIONS

10, 10*a*, 10*b*, 10*c* First advantageous embodiment of the centrifuge insert according to the invention
12 Base element of the centrifuge insert
14, 16 Supplemental element for the base element
18 Central recess
20 Cylinder segment shaped recess
22 Vertically extending groove
24, 26 Outside
28, 30 Bar
32 Base surface of the base element
34, 34', 34" Bar
29, 31 Recess
35, 35', 35" Groove
36 Handle
38 Semi cylindrical space
40 Cover surface 40
42 Edge
44 Outside wall of the central recess 18 and of the recess 20
46 Wall of supplemental element 14
48 Outside protruding rib
59 Axial receiver
60 Axial receiver of supplemental element 16
62 Cylinder segment shaped recess
64 Bar
66 Rib
68 Conical taper of recess 62
70 Conical taper of recess 20
72 Recess
74 Sample container, wide neck bottle 250 ml
76 Sample container, sample tube 50 ml
78 Sample carrier, microtiter plate
80 Base surface of microtiter plate
82 Edge of base surface 80
100 Laboratory centrifuge
102 Housing
104 Cover
106 Sample cavity
108 Centrifuge rotor
110 Centrifuge beaker
200 Second advantageous embodiment of the centrifuge insert according to the invention
202 Base element of the centrifuge insert 200
204 Grip
206 Receiver
208 Base surface
210, 212, 214, 216 Bar
211, 213 Recess
215, 217, 218, 219 Groove
220 Sample container 50 ml
222 Sample carrier, microtiter plate
224 Base surface of microtiter plate 222
226 Edge
300 Third advantageous embodiment of centrifuge insert according to the invention
302 Base element of centrifuge insert 300
304 Receiver
304' Receiver with annular protrusion 336
306 Base surface
308 Sample container reaction vessel 5 ml

310 Base surface of base element 302
312 Support, handle
314, 316, 318, 318', 318" Bar
315, 317 Recess
319, 319', 319" Groove
320 Supplemental element
322 Base surface
324 Wall
326 Receiver
326' Receiver with groove 327
327 Groove of receiver 326'
328 Sample container, sample tube 50 ml
330 Recess of supplemental element 320
334 Base surface of supplemental element 320
336 Annular protrusion of supplemental element 320
338 Sample carrier, microtiter plate
340 Base surface of microtiter plate 338
342 Edge of surface 340
400, 410, 420 Receiver of centrifuge inserts
402, 412, 422 Sample container
D Rotation axis
E Axis of curvature of cylinder segment shaped recess 20
F Axis of curvature of cylinder segment shaped recess 62
G Axis of curvature of sample holder 76

What is claimed is:

1. A centrifuge insert for receiving at least one first element from a group consisting of sample container and sample carrier in a centrifuge rotor of a laboratory centrifuge that is configured as a swing out rotor, wherein the centrifuge insert is adapted to receive the at least one first element which has a circular or oval cross section at least in portions, wherein the centrifuge insert is configured modular with a base element and at least one supplemental element, wherein the at least one supplemental element includes a first supplemental element and a second supplemental element alternatively receivable in the base element, wherein the second supplemental element includes a first external geometry which forms at least one first circular or oval receiver for the at least one first element in cooperation with a corresponding interior geometry of the base element so that the at least one first element is in direct circumferential contact with the second supplemental element and the base element, wherein the first supplemental element includes a second internal geometry which forms a second circular or oval receiver for the at least one first element so that the at least one first element is in direct circumferential contact with the first supplemental element but not in direct circumferential contact with the base element, wherein mass forces from a liquid content of the at least one first element are reacted by the at least one first element and transferred from a closed base of the at least one first element to the base element and from the closed base of the at least one first element to the second supplemental element respectively in a direction of an axis of curvature of the circular or oval cross section of the at least one first element, and wherein the second supplemental element includes a third circumferentially closed internal geometry which forms a third circular or oval receiver for the at least one first element in a center of the first supplemental element.

2. The centrifuge insert according to claim 1, wherein the at least one first element is a sample container, a sample beaker, a sample tube a reaction vessel, a centrifuge vessel, a flask, a micro reaction vessel or a cell culture vessel and includes a conically configured base section.

3. The centrifuge insert according to claim 1, wherein the centrifuge insert is configured to receive the at least one first element in a form locking manner, or wherein a base configuration of receivers of the centrifuge insert is adapted to a base configuration of sample containers or sample carriers to be received and has a flat, conical or cambered contour.

4. The centrifuge insert according to claim 1, wherein the at least one supplemental element is pluggable into the base element or pluggable onto the base element, and wherein a plug connection configured as a groove and key connection is formable between the base element and the at least one supplemental element.

5. The centrifuge insert according to claim 4, wherein the at least one supplemental element includes at least one second receiver for the at least one first element.

6. The centrifuge insert according to claim 1, wherein the centrifuge insert is configured to laterally fix the at least one first element.

7. The centrifuge insert according to claim 1, wherein the centrifuge insert includes at least one bar or protrusion which is adapted to laterally envelop the at least one first element at least partially, or wherein the centrifuge insert includes at least one recess or groove which is adapted to laterally envelop the at least one first element at least partially, wherein the centrifuge insert is adapted to receive the at least one first element by plugging into corresponding receivers of the centrifuge insert.

8. The centrifuge insert according to claim 1, wherein the centrifuge insert includes at least two supports which are arranged opposite to each other and adapted to laterally support the at least one supplemental element, or at least two supplemental elements that are stacked on top of each other.

9. The centrifuge insert according to claim 8, wherein the at least two supports include interlocking connection elements which are adapted to provide an interlocking connection between the at least two supports and the at least one supplemental element.

10. The centrifuge insert according to claim 1, wherein the centrifuge insert includes at least two grips for gripping the centrifuge insert, wherein the at least two grips are arranged opposite to each other and adapted to laterally support the at least one supplemental element, or at least two supplemental elements that are stacked on top of each other.

11. A centrifuge insert for receiving at least one first element from a group consisting of sample container and sample carrier in a centrifuge rotor of a laboratory centrifuge that is configured as a swing out rotor, wherein the centrifuge insert is adapted to receive the at least one first element which has a circular or oval cross section at least in portions, wherein the centrifuge insert is configured modular with a base element and at least one supplemental element, wherein the at least one supplemental element includes at least one external concave geometry which faces towards the base element and forms at least one first receiver for the at least one first element in cooperation with at least one corresponding interior concave geometry of the base element which faces towards the at least one supplemental element so that a circumference of the at least one first element is in direct contact with the at least one supplemental element and the base element, wherein an axis of curvature of the at least one external concave geometry, of the at least one interior concave geometry and of the circular or oval cross section of the at least one first element extends in parallel, wherein a number of the at least one external concave geometry is identical to a number of the at least one corresponding interior concave geometry, wherein mass forces from a liquid content of the at least one first element are reacted by the at least one first element and transferred from a closed base of the at least one first element to the base element and from the closed base of the at least one first element to the first supplemental element respectively in a direction of an axis of curvature of the circular or oval cross section of the at least one first element, and wherein the supplemental element includes a circumferentially closed internal geometry which forms a second circular or oval receiver for the at least one first element in a center of the first supplemental element.

* * * * *